US010935230B2

(12) United States Patent
Xie

(10) Patent No.: US 10,935,230 B2
(45) Date of Patent: Mar. 2, 2021

(54) LUMINAIRE

(71) Applicant: SHENZHEN AURORA TECHNOLOGY CO., LTD, Shenzhen (CN)

(72) Inventor: Qingbo Xie, Shenzhen (CN)

(73) Assignee: SHENZHEN AURORA TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 16/584,526

(22) Filed: Sep. 26, 2019

(65) Prior Publication Data

US 2020/0072455 A1 Mar. 5, 2020

Related U.S. Application Data

(63) Continuation of application No. PCT/CN2018/123777, filed on Dec. 26, 2018.

(30) Foreign Application Priority Data

Sep. 5, 2018 (CN) ..... 201811029428.3

(51) Int. Cl.
*F21V 31/00* (2006.01)
*F21V 29/74* (2015.01)
*H05B 33/04* (2006.01)

(52) U.S. Cl.
CPC ..... *F21V 31/005* (2013.01); *F21V 29/74* (2015.01); *H05B 33/04* (2013.01)

(58) Field of Classification Search
CPC ..... F21V 17/108; F21V 17/14; F21V 7/0083; F21V 31/005; F21V 19/003
See application file for complete search history.

(56) References Cited

U.S. PATENT DOCUMENTS

2009/0262542 A1* 10/2009 Li ..... F21V 3/00 362/373
2015/0266408 A1* 9/2015 Leang ..... B60Q 1/2611 362/516

(Continued)

FOREIGN PATENT DOCUMENTS

CN 201651911 U 11/2010
CN 103851601 A 6/2014

(Continued)

OTHER PUBLICATIONS

International Search Report for International Patent Application No. PCT/CN2018/123777, dated Sep. 5, 2018, 4 pages.

*Primary Examiner* — Eric T Eide
(74) *Attorney, Agent, or Firm* — Jordan IP Law, LLC; Todd A. Vaughn

(57) ABSTRACT

A luminaire that includes a lamp shell, a sealing strip assembly, a light-transmitting panel, a light source assembly, and a pair of end covers respectively fixed to the lamp shell to restrict the light source assembly, the light-transmitting panel, and the sealing strip assembly from protruding from the lamp shell. The lamp shell includes an installation cavity having an opening formed at a front side, an inner wall of the installation cavity being provided with an upper embedding groove and a lower embedding groove corresponding to each other at a position adjacent to the opening. The light-transmitting panel includes an upper end and a lower end respectively embedded in the upper embedding groove and the lower embedding groove, and which are abutted against an inner wall of the upper embedding groove and an inner wall of the lower embedding groove by the sealing strip assembly.

10 Claims, 4 Drawing Sheets

(56) References Cited

U.S. PATENT DOCUMENTS

| | | | | |
|---|---|---|---|---|
| 2016/0201891 | A1* | 7/2016 | Wandrey | F21V 13/04 362/294 |
| 2017/0101046 | A1* | 4/2017 | Beiwen | F21S 41/143 |
| 2018/0058679 | A1* | 3/2018 | Majerczyk | F21V 3/00 |
| 2019/0323688 | A1* | 10/2019 | Ko | F21V 31/00 |

FOREIGN PATENT DOCUMENTS

| | | | |
|---|---|---|---|
| CN | 204328898 | U | 5/2015 |
| CN | 204372584 | U | 6/2015 |
| CN | 109000178 | A | 12/2018 |
| KR | 101228926 | B1 | 2/2013 |

* cited by examiner

LUMINAIRE

CROSS REFERENCE TO RELATED APPLICATIONS

The present application is a continuation of International Application No. PCT/CN2018/123777 (filed on Dec. 26, 2018), which itself claims priority to Chinese Patent Application No. 201811029428.3 (filed on Sep. 5, 2018), each of which is hereby incorporated by reference in their complete entireties.

TECHNICAL FIELD

The present disclosure relates to the field of lighting equipment, and particularly to a luminaire.

BACKGROUND

Currently, for the existing lighting equipment on the market, such as car lamps, spotlights and other luminaires, the light-transmitting panel on the front side of these luminaires generally adopts the traditional screw fastening method to realize fixing, sealing and waterproofing. On the one hand, this existing fixing method is relatively complex in structure, resulting in large size and high cost; on the other hand, the light-transmitting panel of the luminaire is set at the front, so it is easy to contact with water vapor, thus causing the screws to rust easily, and moreover it will further cause the decline of stability of subsequent fastening connection as well as the sealing effect.

SUMMARY

The present disclosure aims to provide a luminaire that can solve the technical problems of the existing luminaire that the screw fastening method adopted by its light-transmitting panel is of complicated structure and the fixing stability will decline along with the extension of the service time.

To achieve the above purpose, the technical scheme adopted by the present disclosure is as follows: a luminaire comprises a lamp shell, a light-transmitting panel, a light source assembly and two end covers, wherein the lamp shell is provided with an installation cavity with an opening formed at the front side, the light source assembly is arranged in the installation cavity, the luminaire further comprises a sealing strip assembly, and upper and lower embedding grooves corresponding to each other are arranged on the inner wall of the installation cavity near the opening. The upper and lower ends of the light-transmitting panel are respectively embedded in the upper embedding groove and the lower embedding groove and are abutted against the inner wall of the upper embedding groove and the inner wall of the lower embedding groove by the sealing strip assembly, the two end covers are respectively fixed at the opposite ends of the lamp shell to jointly restrict the light source assembly, the light-transmitting panel and the sealing strip assembly from coming out from the two sides of the installation cavity.

Preferably, the sealing strip assembly comprises an upper front sealing strip, an upper rear sealing strip, a lower front sealing strip and a lower rear sealing strip.

The upper front sealing strip and the upper rear sealing strip are both arranged in the upper embedding groove, the upper front sealing strip is abutted between the inner front wall of the upper embedding groove and the front side of the light-transmitting panel, and the upper rear sealing strip is abutted between the inner rear wall of the upper embedding groove and the rear side of the light-transmitting panel.

The lower front sealing strip and the lower rear sealing strip are both arranged in the lower embedding groove, the lower front sealing strip is abutted between the inner front wall of the lower embedding groove and the front side of the light-transmitting panel, and the lower rear sealing strip is abutted between the inner rear wall of the lower embedding groove and the rear side of the light-transmitting panel.

Preferably, the inner front wall of the upper embedding groove is provided with an upper front groove, and part of the upper front sealing strip is accommodated in the upper front groove and is abutted against the front side of the light-transmitting panel; the inner front wall of the lower embedding groove is provided with a lower front groove, and part of the lower front sealing strip is accommodated in the lower front groove and is abutted against the front side of the light-transmitting panel.

Preferably, the inner rear wall of the upper embedding groove is provided with an upper rear groove, and part of the upper rear sealing strip is accommodated in the upper rear groove and is abutted against the rear side of the light-transmitting panel; the inner rear wall of the lower embedding groove is provided with a lower rear groove, and part of the lower rear sealing strip is accommodated in the lower rear groove and is abutted against the rear side of the light-transmitting panel.

Preferably, the end of the lamp shell is provided with a plurality of fixing holes, the end cover is provided with a plurality of clearing holes, and each clearing hole corresponds to each fixing hole and is fixedly connected with the fixing hole respectively by fastener passing through it.

Preferably, a sealing gasket is arranged between the end of the lamp shell and the end cover, and the sealing gasket is clamped between the end of the lamp shell and the end cover.

Preferably, the outer sides of the two end covers are both connected with adapters for connecting with external components.

Preferably, the light source assembly comprises a lamp panel and a lamp cup, wherein a plurality of lamp beads are arranged on the lamp panel, the lamp cup is arranged on the front side of the lamp panel, and the lamp cup corresponds to the position of each lamp bead.

Preferably, the lamp shell is an integrally formed aluminum profile shell.

Preferably, a plurality of cooling fins are formed on the outer side of the lamp shell.

The beneficial effects of the present disclosure: for the present luminaire, the upper end and the lower end of the light-transmitting panel positioned at the front side are respectively embedded into the upper embedding groove and the lower embedding groove arranged in the installation cavity, and the light-transmitting panel is abutted against the inner wall of the upper embedding groove and the inner wall of the lower embedding groove by the sealing strip assembly. So the light-transmitting panel is fixed with the inner wall of the installation cavity. And since the sealing strip assembly is elastic, it can seal the light-transmitting panel and the installation cavity in an abutting manner. Finally, the two end covers are fixed at the opposite ends of the lamp shell, and the two end covers act together to restrict the light source assembly, the light-transmitting panel and the sealing strip assembly from coming out from the two sides of the installation cavity, so that the fixing of the light-transmitting panel can be realized without using fasteners, and there is no need to worry that the sealing stability of the light-transmitting panel may be influenced by water vapor after long-term use.

DRAWINGS

To more clearly explain the technical scheme in the embodiment of the present disclosure, in the following, it will briefly introduce the embodiments or the drawings applied in the existing technical description. Obviously, the drawings in the following description are only some embodiments of the present disclosure. For ordinary technicians in this field, without additional creative efforts, other drawings can be obtained by referring to these ones.

DESCRIPTION

Figure 1:
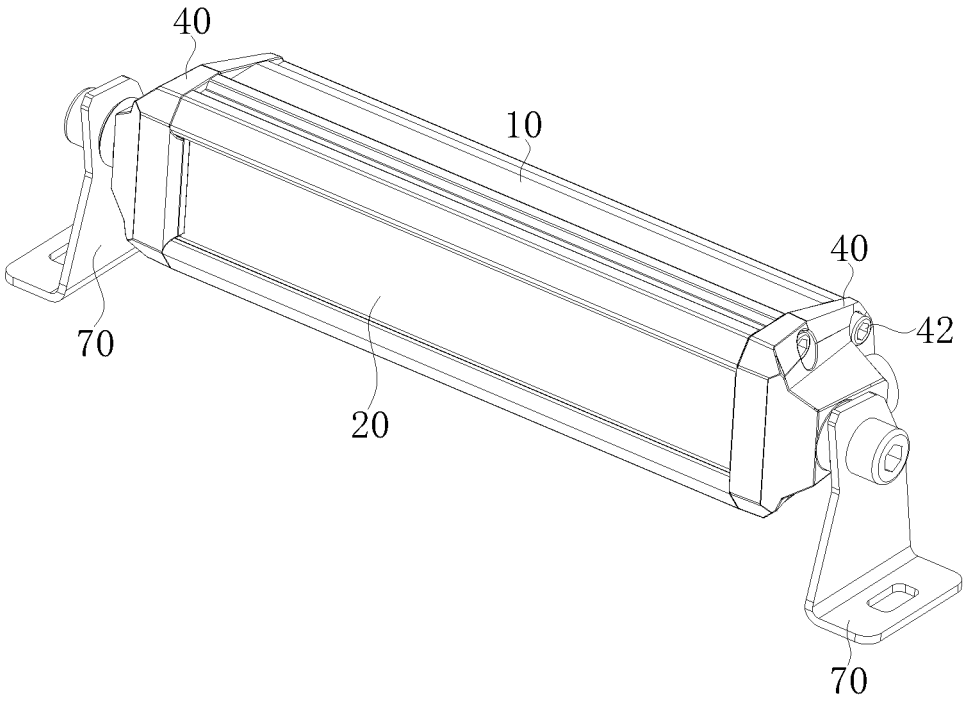
FIG. 1 is a structural schematic diagram of a luminaire that is an embodiment of the present disclosure.
Figure 2:
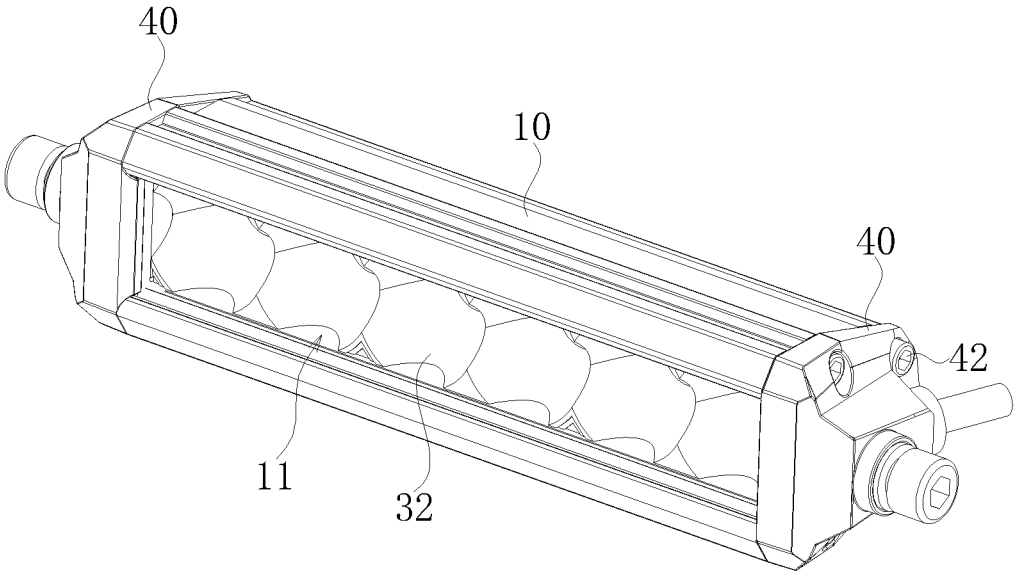
FIG. 2 is a structural schematic diagram of a luminaire with its light-transmitting panel and adapters hidden that is an embodiment of the present disclosure.

In the following, embodiments of the present disclosure will be described in detail, examples of which are illustrated in the figures, wherein the same or similar reference numerals refer to the same or similar elements or elements having the same or similar functions for all. The embodiments described below with reference to FIGS. 1 to 6 are exemplary and are intended to explain the present disclosure which shall not to be construed as the limitation of the present disclosure.

In the description of the present disclosure, it is to be understood that the orientation or positional relationship indicated by the terms "length", "width", "upper", "lower", "front", "rear", "left", "right", "vertical", "horizontal", "top", "bottom", "inner", "outer" and the like are based on the orientation or positional relationship shown in the figures, only for convenience of describing the present disclosure and simplifying the description, but not for indication or implication that the indicated device or element must have a specific orientation, be constructed and operate in a specific orientation, and therefore cannot be understood as a limitation of the present disclosure.

Furthermore, the terms "first" and "second" are used for descriptive purposes only and cannot be understood as indicating or implying relative importance or implicitly indicating the number of technical features indicated. Thus, a feature defining "first" and "second" may explicitly or implicitly include one or more of the features. In the description of the present disclosure, the meaning of "plural" includes two or more, unless otherwise specifically defined.

In the present disclosure, unless otherwise explicitly specified and defined, the terms "install", "connected", "connect", "fix" and the like shall be understood broadly. For example, it can be fixedly connected, detachably connected or integrated; it can be mechanically connected or electrically connected; it can be directly connected, indirectly connected through an intermediate medium, and can be the internal connection of two elements or the interaction relationship of two elements. For ordinary technicians in this field, the specific meanings of the above terms in the present disclosure can be understood according to specific situations.

As shown in FIGS. 1 to 4, the luminaire of the embodiment of the present disclosure is suitable for, but not limited to, automobile, motorcycle, ship and various luminaire application places, for example, severing as car lamps, spotlights, plant lamps, wall washer lamps, street lamps or light pipes. The luminaire comprises a lamp shell 10, a light-transmitting panel 20, a light source assembly 30 and two end covers 40, wherein the lamp shell 10 is provided with an installation cavity 11 with an opening at the front side, and the light source assembly 30 is arranged in the installation cavity 11. The lamp shell 10 provides support and installation for the entire structure. The light source assembly 30 gives out light after being connected to the external power supply, playing a lighting role. On the one hand, the light-transmitting panel 20 seals the opening formed at the front side of the installation cavity 11, and on the one hand it plays a role in transmitting light.

Figure 3:
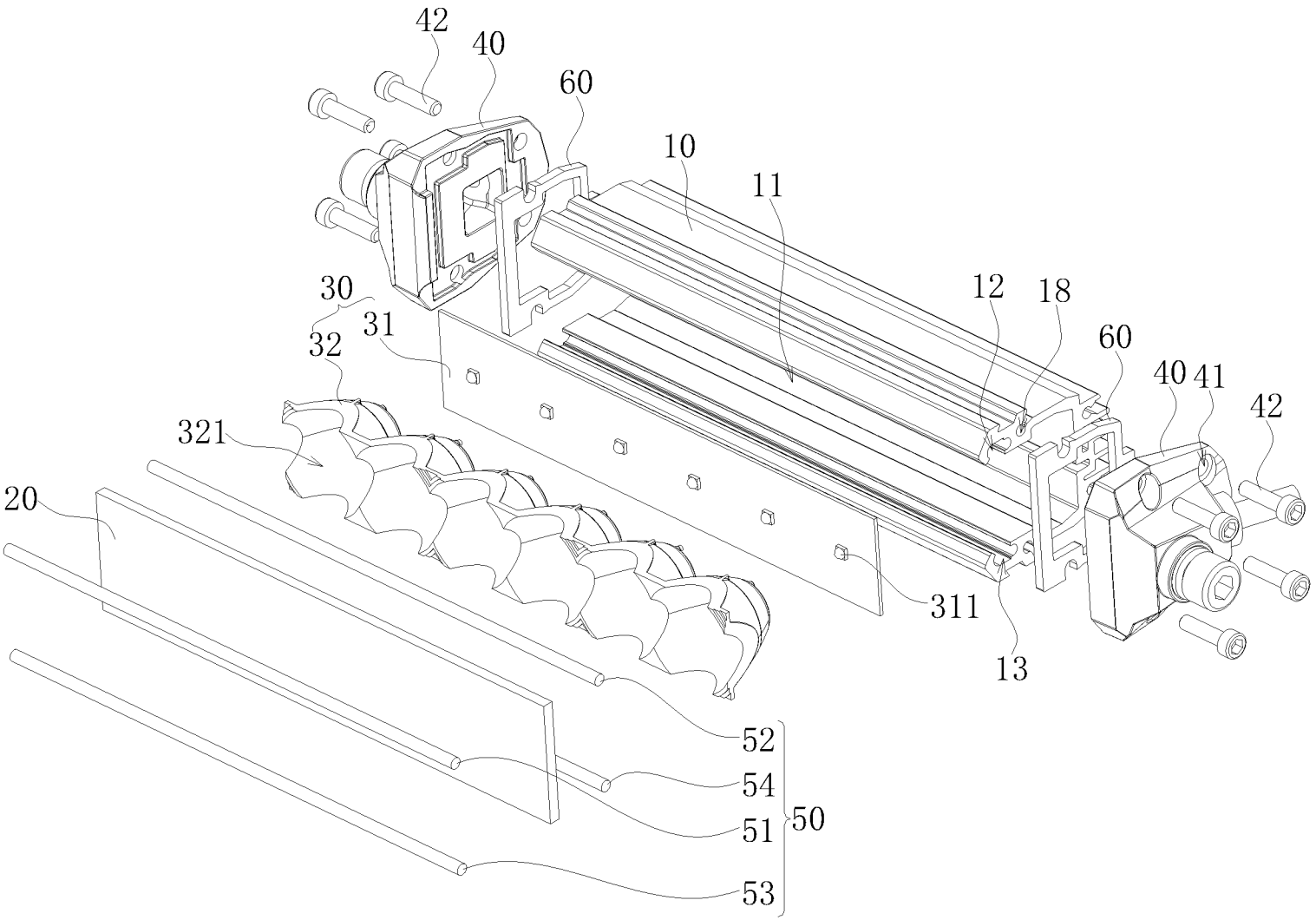
FIG. 3 is a structural decomposition schematic diagram of a luminaire that is an embodiment of the present disclosure.
Figure 4:
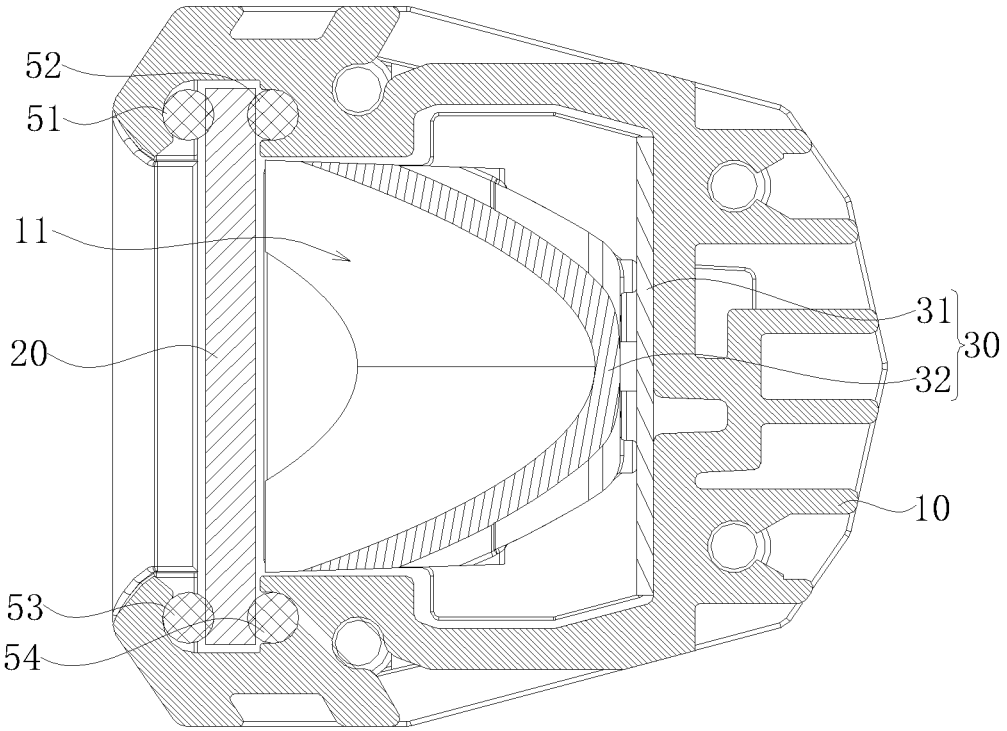
FIG. 4 is a sectional view of a luminaire that is an embodiment of the present disclosure.

Furthermore, as shown in FIGS. 3 and 4, the luminaire further includes a sealing strip assembly 50, and the inner wall of the installation cavity 11 is provided with upper embedding groove 12 and lower embedding groove 13 corresponding to each other at a position close to the opening. The upper and lower ends of light-transmitting panel 20 are respectively embedded into the upper embedding groove 12 and the lower embedding groove 13. And the light-transmitting panel 20 is abutted against the inner wall of the upper embedding groove 12 and the inner wall of the lower embedding groove 13 by the sealing strip assembly 50, i.e. the sealing strip assembly 50, via the light-transmitting panel 20, is jointly pressed by the inner wall of the upper embedding groove 12 and the inner wall of the lower embedding groove 13. Thus, on one hand the position of the light-transmitting panel 20 is fixed, and on the other hand the gap between the light-transmitting panel 20 and the inner wall of the upper embedding groove 12 and the gap between the light-transmitting panel 20 and the lower embedding groove 13 are sealed. The two end covers 40 are respectively fixed at the opposite ends of the lamp shell 10, and jointly restrict the light source assembly 30, the light-transmitting panel 20 and the sealing strip assembly 50 from coming out from the two sides of the installation cavity 11. In this way, the light source assembly 30, the light-transmitting panel 20 and the sealing strip assembly 50 cannot come out of the installation cavity 11 from both sides of the installation cavity 11.

Specifically, for the luminaire of the embodiment of the present disclosure, the upper and lower ends of the light-transmitting panel 20 located at the front side are respectively embedded into the upper embedding groove 12 and the lower embedding groove 13 provided in the installation cavity 11, and the light-transmitting panel 20 is abutted against the inner wall of the upper embedding groove 12 and the inner wall of the lower embedding groove 13 with the sealing strip assembly 50. So the light-transmitting panel 20 is fixed with the inner wall of the installation cavity 11. And since the sealing strip assembly 50 is elastic, it can seal the light-transmitting panel 20 and the installation cavity 11 in an abutting manner. Finally two end covers 40 are fixed at the opposite ends of the lamp shell 10, and the two end covers 40 act together to restrict the light source assembly 30, the light-transmitting panel 20 and the sealing strip assembly 50 from coming out from the two sides of the installation cavity 11, so that the fixing of the light-transmitting panel 20 can be realized without using fastener 42, and there is no need to worry that the sealing stability of the light-transmitting panel 20 may be influenced by water vapor after long-term use.

For the luminaire of the embodiment, the assembly parts are reduced and the assembly time is reduced; the assembly error caused by the cooperation of a plurality of parts is reduced; the costs of materials, assembly time and production are reduced.

Preferably, the luminaire of this embodiment is preferably a strip luminaire that is to be applied at the front side of the head of an off-road vehicle.

Figure 5:
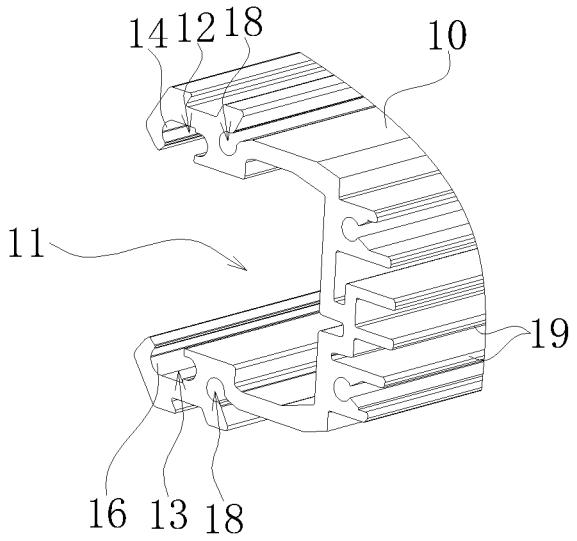
FIG. 5 is a schematic diagram I of a partial structure of a lamp shell of a luminaire that is an embodiment of the present disclosure.
Figure 6:
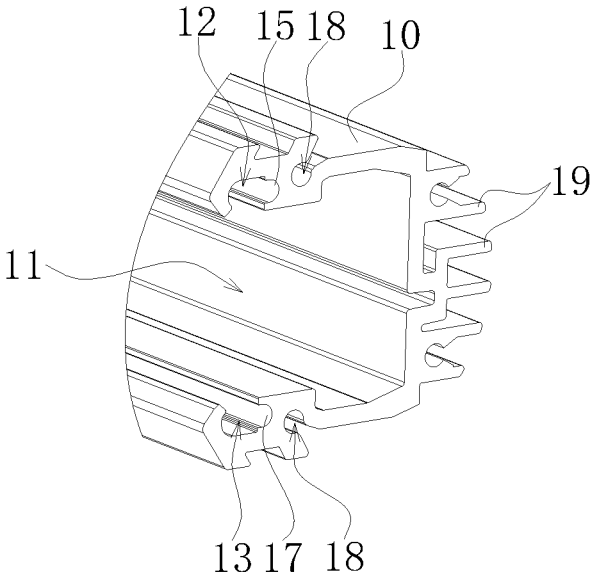
FIG. 6 is a schematic diagram II of a partial structure of a lamp shell of a luminaire that is an embodiment of the present disclosure.

Wherein, as shown in FIGS. 5 to 6, both sides of the installation cavity 11 are in an open state suitable for the two end covers 40 to cover on. The light-transmitting panel 20 and the sealing strip assembly 50 of the light source assembly 30 are all installed by being inserted into the installation cavity 11 from its two sides. So the opening on the front side of the installation cavity 11 shall be set smaller than the area of the light-transmitting panel 20, thus ensuring that the upper and lower ends of the light-transmitting panel 20 can be embedded into deeper positions of the upper embedding groove 12 and the lower embedding groove 13 so as to facilitate the sealing and fixing of the light-transmitting panel 20.

Preferably, the light-transmitting panel 20 is a transparent panel.

Preferably, the light-transmitting panel 20 is a PC panel. (PC: polycarbonate).

In this embodiment, as shown in FIGS. 3 and 4, the sealing strip assembly includes an upper front sealing strip 51, an upper rear sealing strip 52, a lower front sealing strip 53, and a lower rear sealing strip 54; preferably, the structures and materials of the upper front sealing strip 51, the upper rear sealing strip 52, the lower front sealing strip 53, and the lower rear sealing strip 54 are all of box-shaped, and the cross-sectional shape may be circular, oval, rectangular, or the like. For example, the upper front sealing strip 51, the upper rear sealing strip 52, the lower front sealing strip 53 and the lower rear sealing strip 54 may be made of flexible glue.

Furthermore, as shown in FIGS. 3 and 4, the upper front sealing strip 51 and the upper rear sealing strip 52 are both arranged in the upper embedding groove 12, and the upper front sealing strip 51 abuts between the inner front wall of the upper embedding groove 12 and the front side of the light-transmitting panel 20, thus the upper front sealing strip 51 seals the gap between the light-transmitting panel 20 and the inner front wall of the upper embedding groove 12 under the joint squeezing action of the two. The upper rear sealing strip 52 abuts between the inner rear wall of the upper embedding groove 12 and the rear side of the light-transmitting panel 20; similarly, the upper rear sealing strip 52 seals the gap between the light-transmitting panel 20 and the inner rear wall of the upper embedding groove 12 under the joint squeezing action of the two.

In this way, the upper front sealing strip 51 and the upper rear sealing strip 52 jointly exert a force on the front and rear sides of the part of the light-transmitting panel 20 embedded in the upper embedding groove 12 so as to fix and seal the light-transmitting panel 20.

Furthermore, as shown in FIGS. 3 and 4, the lower front sealing strip 53 and the lower rear sealing strip 54 are both arranged in the lower embedding groove 13, and the lower front sealing strip 53 abuts between the inner front wall of the lower embedding groove 13 and the front side of the light-transmitting panel 20, thus the lower front sealing strip 53 seals the gap between the light-transmitting panel 20 and the inner front wall of the lower embedding groove 13 under the joint squeezing action of the two. The lower rear sealing strip 54 abuts between the inner rear wall of the lower embedding groove 13 and the rear side of the light-transmitting panel 20; similarly, the lower rear sealing strip 54 seals the gap between the light-transmitting panel 20 and the inner rear wall of the lower embedding groove 13 under the joint squeezing action of the two.

In this way, the lower front sealing strip 53 and the lower rear sealing strip 54 jointly exert a force on the front and rear sides of the part of the light-transmitting panel 20 embedded in the lower embedding groove 13 so as to fix and seal the light-transmitting panel 20.

In this way, under the joint action of the upper front sealing strip 51 and the upper rear sealing strip 52, as well as the lower front sealing strip 53 and the lower rear sealing strip 54, the upper and lower ends of the light-transmitting panel 20 are sealed and fixed in the upper embedding groove 12 and the lower embedding groove 13 respectively, i.e. the opening of the front side before installation is sealed, so that the front side of the whole lamp realizes installment without fastener 42 (without screws). There is no need to worry about the influence of water vapor on the sealing and fixing of the light-transmitting panel 20, and the stability and sealing performance can be guaranteed after long-term use.

In this embodiment, as shown in FIGS. 4 to 6, the inner front wall of the upper embedding groove 12 is provided with an upper front groove 14. Preferably, the cross section of the upper front groove 14 is approximately semicircular. Part of the upper front sealing strip 51 is accommodated in the upper front groove 14 and abuts against the front side of the light-transmitting panel 20, i.e., the front side part of the upper front sealing strip 51 is accommodated in the upper front groove 14 and abuts against the inner wall of the upper front groove 14; specifically, the upper front groove 14 can accommodate and position the upper front sealing strip 51, which, on the one hand, facilitates the installation of the upper front sealing strip 51, and, on the other hand, also plays a role in limiting the position of the installed upper front sealing strip 51, so as to prevent the displacement of the upper front sealing strip 51 from affecting the abutting effect on the light-transmitting panel 20.

Furthermore, as shown in FIGS. 4 to 6, the inner front wall of the lower embedding groove 13 is provided with a lower front groove 16. Preferably, the cross section of the upper front groove 14 is approximately semicircular. Part of the lower front sealing strip 53 is accommodated in the lower front groove 16 and abuts against the front side of the light-transmitting panel 20, i.e., the front side part of the lower front sealing strip 53 is accommodated in the lower front groove 16 and abuts against the inner wall of the lower front groove 16; specifically, the lower front groove 16 can accommodate and position the lower front sealing strip 53, which, on the one hand, facilitates the installation of the lower front sealing strip 53, and, on the other hand, also plays a role in limiting the position of the installed lower front sealing strip 53, so as to prevent the displacement of the lower front sealing strip 53 from affecting the abutting effect on the light-transmitting panel 20.

In this embodiment, as shown in FIGS. 4 to 6, the inner rear wall of the upper embedding groove 12 is provided with an upper rear groove 15, and preferably, the cross section of the upper rear groove 15 is approximately semicircular. Part of the upper rear sealing strip 52 is accommodated in the upper rear groove 15 and abuts against the rear side of the light-transmitting panel 20, i.e., the front side part of the upper rear sealing strip 52 is accommodated in the upper rear groove 15 and abuts against the inner wall of the upper rear groove 15; specifically, the upper rear groove 15 can accommodate and position the upper rear sealing strip 52, which, on the one hand, facilitates the installation of the upper rear sealing strip 52, and, on the other hand, also plays a role in limiting the position of the installed upper rear sealing strip 52, so as to prevent the displacement of the upper rear sealing strip 52 from affecting the abutting effect on the light-transmitting panel 20.

Furthermore, as shown in FIGS. 4 to 6, the inner rear wall of the lower embedding groove 13 is provided with a lower rear groove 17, and preferably, the cross section of the lower rear groove 17 is approximately semicircular. Part of the lower rear sealing strip 54 is accommodated in the lower rear groove 17 and abuts against the rear side of the light-transmitting panel 20, i.e., the front side part of the lower rear sealing strip 54 is accommodated in the lower rear groove 17 and abuts against the inner wall of the lower rear groove 17; specifically, the lower rear groove 17 can accommodate and position the lower rear sealing strip 54, which, on the one hand, facilitates the installation of the lower rear sealing strip 54, and, on the other hand, also plays a role in limiting the position of the installed lower rear sealing strip 54, so as to prevent the displacement of the lower rear sealing strip 54 from affecting the abutting effect on the light-transmitting panel 20.

In this embodiment, as shown in FIG. 3, the end of the lamp shell 10 is provided with a plurality of fixing holes 18, the end cover 40 is provided with a plurality of clearing holes 41, and each clearing hole 41 corresponds to each fixing hole 18 and the clearing holes 41 are fixedly connected with the fixing holes 18 respectively by fasteners 42 passing through them. Specifically, the fastener 42 can be a screw or a bolt, the fixing hole 18 can be a threaded hole, and the clearing hole 41 can be a smooth hole. Thus, when the fastener 42 passes through the clearing hole 41 and is screwed with the corresponding fixing hole 18, the end cover 40 can be fixed at the end of the lamp shell 10, which not only has good stability of fixing connection, but also is easy to assemble and disassemble, and is convenient for later maintenance of the lamp.

Preferably, there are four pairs of corresponding clearing holes 41 and fixing holes 18, and they are arranged at four corners. So after the end cover 40 is fixed at the end of the lamp shell 10, the stability of each part can be more balanced.

Of course, in other embodiments, the fasteners 42 may be rivets, and the fixing holes 18 may be riveting holes. In this case, the end cover 40 is fixed to the end of the lamp shell 10 by riveting the rivets passing through the clearing holes 41 to the fixing holes 18.

In this embodiment, as shown in FIG. 3, a sealing gasket 60 is arranged between the end of the lamp shell 10 and the end cover 40, and the sealing gasket 60 is clamped between the end of the lamp shell 10 and the end cover 40. The sealing gasket 60 is preferably made of the flexible rubber. The arrangement of the sealing gasket 60 can seal the gap between the end cover 40 and the end of the lamp shell 10, i.e., the clamping on the sealing gasket 60 by the end cover 40 and the end of the lamp shell 10 deforms the sealing gasket 60, and the deformed sealing gasket 60 seals the gap between the end cover 40 and the end of the lamp shell 10, thereby forming a seal between the end cover 40 and the end of the lamp shell 10.

In this embodiment, as shown in FIG. 1, the outer sides of the two end covers 40 are both connected with adapters 70 for connecting with external components. The adapter 70 may be a metal piece, and the purpose of arranging the adapter 70 is to conveniently fix the whole lamp on preset external components, so as to improve the universality of the lamp, and make the lamp convenient to install.

In this embodiment, as shown in FIG. 3, the light source assembly 30 includes a lamp panel 31 and a lamp cup 32, wherein the lamp panel 31 is provided with a plurality of lamp beads 311, the lamp cup 32 is arranged on the front side of the lamp panel 31, and the lamp cup 32 corresponds to the position of each lamp bead 311. Specifically, the lamp bead 311 may be LED. The lamp cup 32 includes a plurality of reflection cavities 321, each reflection cavity 321 is arranged corresponding to a lamp bead 311.

In this embodiment, the lamp shell 10 is an integrally formed aluminum profile shell. When used as the lamp shell 10, the aluminum profile shell, on the one hand, is high in structural strength; on the other hand, it has a cooling function that can dissipate the heat generated by the lamp panel 31 in time, bringing good effect and strong practicality.

In this embodiment, as shown in FIGS. 5 and 6, a plurality of cooling fins 19 are arranged on the outer side of the lamp shell 10. Specifically, the arrangement of the cooling fins 19 further increases the effective heat dissipation area, so that the heat generated by the lamp panel 31 can be dissipated into the air in a more timely manner, avoiding damage to the lamp caused by high temperature.

The above description is only a preferred embodiment of the present disclosure and is not intended to limit the application of present disclosure. Any modification, equivalent substitution and improvement made within the spirit and principles of the present disclosure shall be included within the scope of protection of the present disclosure.

LIST OF REFERENCE SYMBOLS

The various reference numerals in the figures are as follows:

10—lamp shell
11—installation cavity
12—upper embedding groove
13—lower embedding groove
14—upper front groove
15—upper rear groove
16—lower front groove
17—lower rear groove
18—fixing hole
19—cooling fins
20—light-transmitting panel
30—light source assembly
31—lamp panel
32—lamp cup
40—end cover
41—clearing hole
42—fastener
50—sealing strip assembly
51—upper front sealing strip
52—upper rear sealing strip
53—lower front sealing strip
54—lower rear sealing strip
60—sealing gasket
70—adapter

311—lamp bead

321—reflection cavity

What is claimed is:

1. A luminaire, comprising:

a lamp shell, integrally formed from aluminum, having an installation cavity with an opening formed at a front side thereof, an inner wall of the installation cavity being provided with an upper embedding groove and a lower embedding groove each having a 'C' cross-sectional shape and corresponding to each other at a position adjacent to the opening, an inner front wall of the upper embedding groove being provided with an upper front groove, and an inner front wall of the lower embedding groove being provided with a lower front groove;

a sealing strip assembly composed of an elastic material, the sealing strip assembly comprising an upper front sealing strip arranged in the upper embedding groove and having a region thereof accommodated in the upper front groove to abut against an inner wall of the upper front groove, and a lower front sealing strip arranged in the lower embedding groove and having a region thereof accommodated in the lower front groove to abut against an inner wall of the lower front groove, wherein the upper front sealing strip and the lower front sealing strip respectively have cross-sectional shapes that are circular, oval, or rectangular;

a light-transmitting panel having an upper end and a lower end respectively embedded in the upper embedding groove and the lower embedding groove, and which are abutted against an inner wall of the upper embedding groove and an inner wall of the lower embedding groove by the sealing strip assembly, wherein the upper front sealing strip is abutted between the inner front wall of the upper embedding groove and the front side of the light-transmitting panel and the lower front sealing strip is abutted between the inner front wall of the lower embedding groove and the front side of the light-transmitting panel;

a light source assembly arranged in the installation cavity; and a pair of end covers that are respectively fixed at opposite ends of the lamp shell to jointly restrict the light source assembly, the light-transmitting panel, and the sealing strip assembly from protruding from the installation cavity.

2. The luminaire of claim 1, wherein the sealing strip assembly comprises an upper rear sealing strip and a lower rear sealing strip.

3. The luminaire of claim 2, wherein:

the upper rear sealing strip is arranged in the upper embedding groove and abutted between the inner rear wall of the upper embedding groove and the rear side of the light-transmitting panel.

4. The luminaire of claim 2, wherein:

the lower rear sealing strip is arranged in the lower embedding groove and abutted between the inner rear wall of the lower embedding groove and the rear side of the light-transmitting panel.

5. The luminaire of claim 2, wherein:

an inner rear wall of the upper embedding groove is provided with an upper rear groove, a region of the upper rear sealing strip is accommodated in the upper rear groove and abutted against an inner wall of the upper rear groove, and an inner rear wall of the lower embedding groove is provided with a lower rear groove, a region of the lower rear sealing strip is accommodated in the lower rear groove and abutted against an inner wall of the lower rear groove.

6. The luminaire of claim 1, further comprising:

a plurality of fixing holes provided at an end region of the lamp shell, a plurality of clearing holes provided at the end cover, the clearing holes corresponding to and fixedly connected to the fixing holes by a fastener passing therethrough.

7. The luminaire of claim 1, further comprising a sealing gasket, arranged and clamped between an end region of the lamp shell and the end cover.

8. The luminaire of claim 1, further comprising adapters connected with outer sides of the end covers for connecting with external components.

9. The luminaire of claim 1, wherein the light source assembly comprises a lamp panel, a lamp cup arranged on a front side of the lamp panel, and a plurality of lamp beads arranged on the lamp panel, the lamp cup spatially corresponding to a position of each lamp bead.

10. The luminaire of claim 1, further comprising a plurality of cooling fins arranged on an outer surface of the lamp shell.

* * * * *